United States Patent [19]

Stuckey

[11] 3,997,978

[45] Dec. 21, 1976

[54] ROPE CONDITIONING APPARATUS

[76] Inventor: Alfred R. Stuckey, P.O. Box 386, Astatula, Fla. 32703

[22] Filed: Sept. 8, 1975

[21] Appl. No.: 611,189

[52] U.S. Cl. ..... 34/104; 34/202; 219/220; 219/521; 219/524

[51] Int. Cl.[2] ..... F26B 25/00

[58] Field of Search ..... 219/201, 220, 385, 386, 219/387, 400, 521, 524, 533, 525, 535; 34/104, 202, 218, 220

[56] References Cited

UNITED STATES PATENTS

| | | | |
|---|---|---|---|
| 890,081 | 6/1908 | Moore | 219/524 |
| 1,940,172 | 12/1933 | Hybinette | 219/220 X |
| 2,023,861 | 12/1935 | Stienen | 34/104 X |
| 2,085,551 | 6/1937 | Stienen | 34/104 |
| 2,577,327 | 12/1951 | Hill | 34/104 X |
| 2,643,465 | 6/1953 | Douglass | 34/104 X |
| 3,188,752 | 6/1965 | Skinner | 34/104 |
| 3,209,466 | 10/1965 | Van Lear | 34/104 |
| 3,287,824 | 11/1966 | Seiditz | 34/202 |
| 3,393,295 | 7/1968 | Jepson et al. | 219/524 X |
| 3,640,001 | 2/1972 | Ellison | 219/521 X |

FOREIGN PATENTS OR APPLICATIONS

| | | | |
|---|---|---|---|
| 554,718 | 3/1958 | Canada | 219/525 |
| 1,175,940 | 1/1970 | United Kingdom | 34/104 |

*Primary Examiner*—Volodymyr Y. Mayewsky
*Attorney, Agent, or Firm*—Duckworth, Hobby, Orman, Allen & Pettis

[57] ABSTRACT

An apparatus for conditioning flexible ropes which has a hollow housing adapted to receive a flexible rope in a coiled condition. The housing contains a heating element for heating the air which comes in contact with the rope, thereby removing excess moisture from the rope. A venting and air circulation system is provided to remove excess moisture from the housing. When the heating element is not in use, the housing may be used as a carrying case for the rope. Automatic and manual devices are provided for controlling the heating element.

5 Claims, 4 Drawing Figures

ROPE CONDITIONING APPARATUS

BACKGROUND OF THE INVENTION

1. Field of the Invention

The present invention relates to an apparatus for conditioning a flexible rope and in particular relates to a heated casing for removing moisture from a woven hemp or manila rope.

2. Description of the Prior Art

The proper care of woven hemp and manila ropes is important to those persons involved in ranch work and also to competitive rodeo cowboys. The woven natural fiber ropes tend to absorb moisture under conditions of high humidity. These conditions cause the fibers to become stiff, making the rope or lasso difficult to throw.

The method presently employed by competitive rodeo cowboys involves placing the wet rope under the hood of a car on top of a warm engine. However, these ropes are often forgotten and thereafter become entangled in the engine fan, belts, etc. In addition, the natural fibers will absorb any residual fuel or lubricants present on top of the engine or underneath the automobile hood.

The present invention has a cylindrically shaped housing for transporting a rope in a coiled condition. An internal heating element is powered by an automotive electrical system through a cigarette lighter adaptor. A venting and air circulation system removes the excess moisture from the housing. With the use of this invention, the cowboy can obtain the proper moisture content of the rope and then maintain this moisture content throughout the period of travel to the place of competition or work. The ropes arrive ready for use, with the desired moisture content and free of any grease or oil. The use of a clean rope having a predetermined moisture content can yield more consistent results and more consistent winnings for a cowboy involved in rodeo competition.

One prior art device is disclosed in U.S. Pat. No. 3,375,047, which teaches the use of a sealed cylindrical housing which contains an axially located electrical heating element powered by an electrical source. The heating element heats the air and causes the evaporation of moisture from the rope. However, when the proper moisture content is reached the rope must be removed from the rope conditioner since no system for venting is provided for the removal of moisture contained in the heated air. Also, this device does not provide automatic timing or temperature regulating features for unattended rope conditioning.

In a related invention in U.S. Pat. No. 2,180,213, a heated enclosure is used for drying and storing tooth brushes. Other similar devices use heating elements to warm various articles prior to their use include those taught in U.S. Pat. No. 2,294,991, for a combination razor strop holder and heater; U.S. Pat. No. 3,405,859 for a device used to heat keys for defrosting frozen locks; and in U.S. Pat. No. 3,624,346 a heated bowling ball bag is disclosed.

SUMMARY OF THE INVENTION

The present invention is an electrically heated rope housing and rope conditioning apparatus having a hollow housing adapted to receive a flexible coiled rope. The housing contains a heating element for varying the temperature and the moisture content of a flexible rope. A venting and circulation system removes excess moisture from the housing, and a timing device and an on-off switch are included in the electrical circuit which powers the heating element. The rope is coiled and then placed within the heated housing for conditioning. The housing may also be used to transport the rope while maintaining a predetermined temperature and moisture content.

BRIEF DESCRIPTION OF THE DRAWINGS

Other objects, features and advantages of the present invention will be apparent from a study of the written description and the drawings, in which.

DETAILED DESCRIPTION OF THE INVENTION

Figure 1:
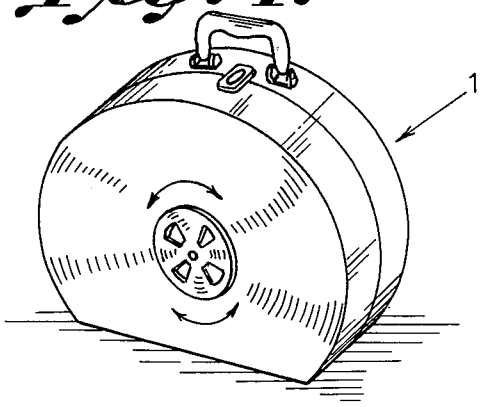
FIG. 1 is a perspective view of the closed rope conditioning apparatus.
Figure 2:
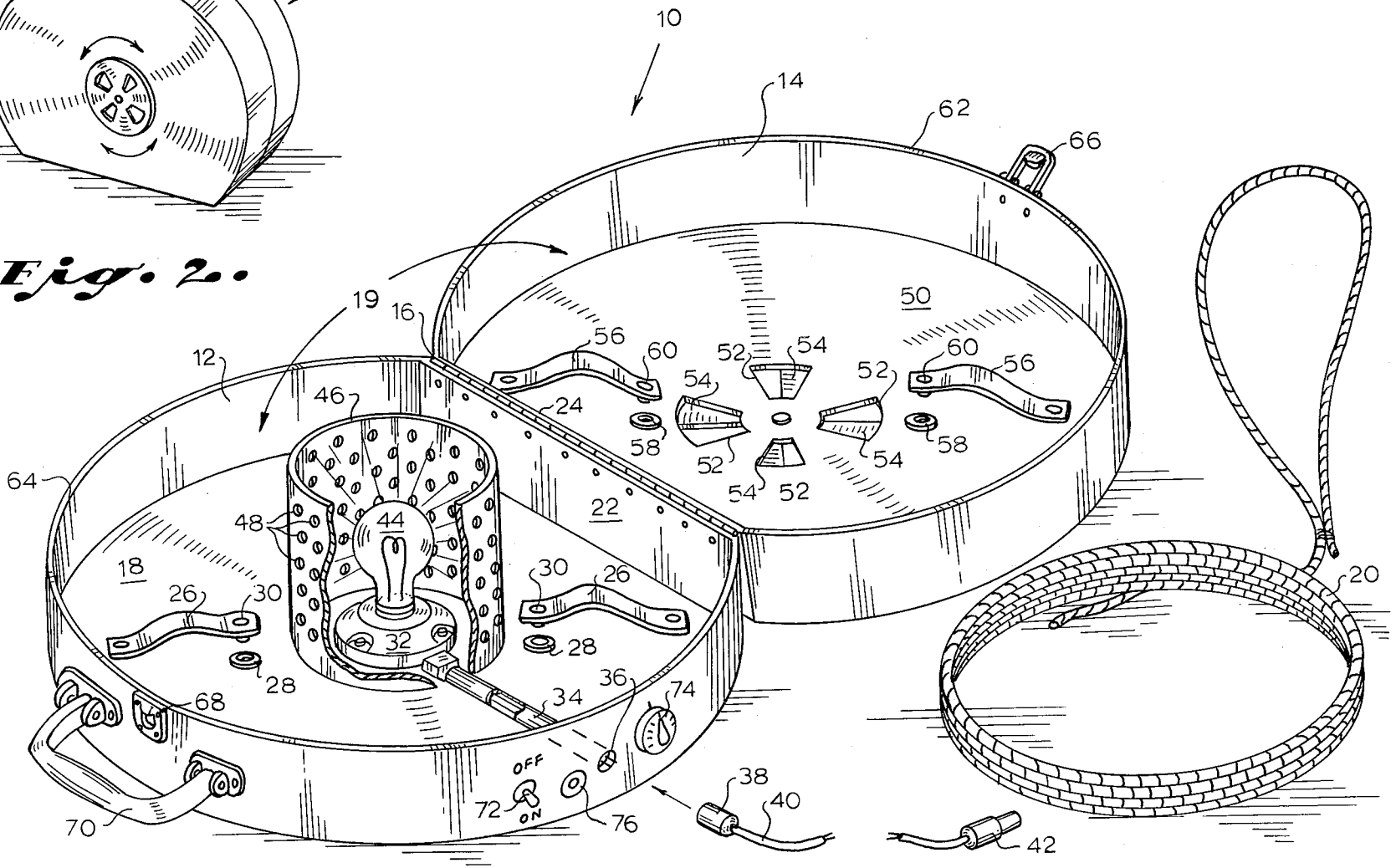
FIG. 2 is a perspective view of the opened rope conditioning apparatus of FIG. 1.

Referring to FIGS. 1 and 2 of the drawings, a rope conditioning apparatus 10 includes a generally cylindrical housing base 12 and a generally cylindrical housing cover 14 which are movably attached by a hinge 16, which is attached to the flat portions of surfaces 22 and 24. The hollow interiors of the housings 12 and 14 define a cylindrical rope storage chamber 19. The housing base 12 includes a bottom surface 18 to which are attached multiple restraining devices 26. These flexible restraining devices 26 have a snap 30 attached to the distal end thereof for coupling with a second snap element 28 secured to the bottom surface 18 of the housing base 12. A screw-type electrical receptacle 32 is mounted at approximately the center of the bottom surface 18 of the housing base 12. An electrical conductor pair 34 communicates between the electrical socket 32 and a male power connector 36 located on the circumferential surface of housing base 12. A female power connector 38, which is adapted to mate with the power connector 36, is connected to an electrical conductor pair 40 which terminates in a power connector 42, which is adapted to be inserted within the cigarette lighter receptacle of an automobile or other suitable source of AC or DC electrical power.

An electrical light bulb 44 is rotatably attached to the electrical socket 32. The present embodiment of the rope conditioning apparatus envisions the use of a 25 to 100 watt light bulb to be powered by a 10 to 15 volt DC power source. However, an electrical heating element of the type used in toasters, electric skillets, etc., may be substituted without degrading the performance of the rope conditioning apparatus. Also, heating elements or light bulbs of higher wattage are envisioned for the accelerated drying of very wet ropes, and smaller light bulbs or heating elements are envisioned for merely maintaining the moisture content of a rope in storage. An electrical device 76 is included for varying the voltage applied to the heating element 44. The heating capacity of the heater element 44 will be determined by the type of rope being used, the physical condition of the rope, the moisture content of the rope, the temperature of the rope, the external temperature, the availability of power and the available time for preconditioning.

A cylindrical shield 46 is attached to the bottom surface 18 of the housing base 12. The shield 46 surrounds the heating element 44 and prevents a rope 20 from being scorched or burned thereby. Multiple perforations 48 in shield 46 allow air which has been heated by the heating element 44 to escape from within the shield and flow into the housing. The height of the shield 46 is such as to communicate with a top surface 50 when the housing cover 14 congruently couples with the housing base 12. Multiple vent openings 52 are located in the top surface 50 of housing cover 14 adjacent to heating element 44 and shield 46. Adjustable slides 54 are movably attached to the top surface 50 and rotate adjacent to the vents 52 to vary the size of the openings therethrough. Multiple flexible restraining devices 56 are attached to the top surface 50 of the housing cover 14. A snapping device 60 is attached to the distal end of the restraining element 56 and couples with a mating snapping receptacle 58 attached to the top surface of the housing cover.

The housing cover 14 rotates about the hinge 16 to communicate with the housing base 12. The circumferential edge 62 of the housing 14 congruently couples with the circumferential edge 64 of the housing base 12, thereby providing a relatively airtight, hollow housing. A hinged latch 66 is attached to the circumferential surface of the housing cover 14 and is adapted to couple to a latch receptacle 68 on the circumferential surface of the housing base 12, when in the closed condition. A suitable handle 70 is movably attached to the circumferential surface of the housing base 12 to facilitate the carrying of the housing.

Figures 3, 4:
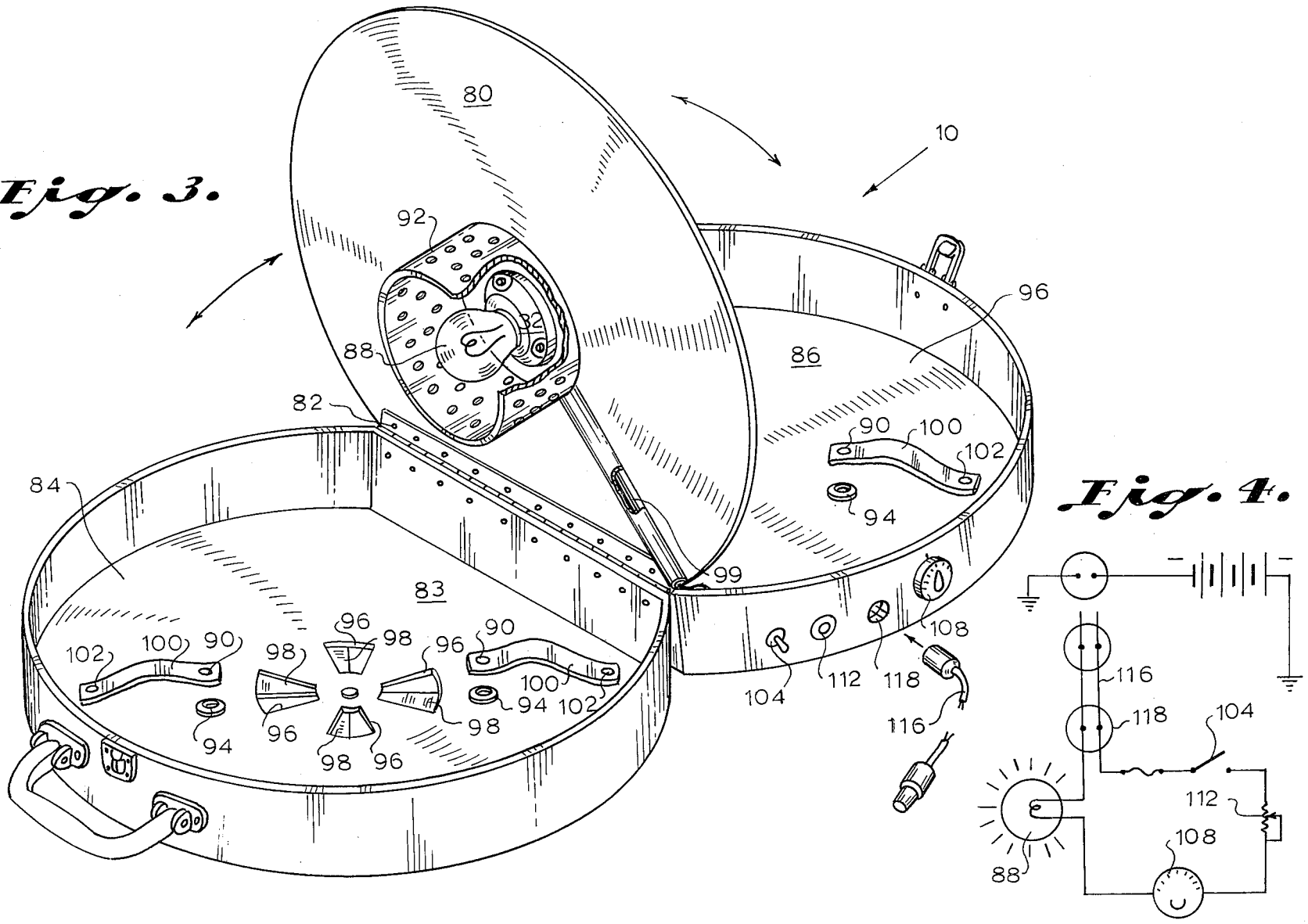
FIG. 3 is a perspective view of a second preferred embodiment of a rope conditioning apparatus.
FIG. 4 is a schematic diagram of the electrical circuit supplying power to the heating element.

With reference to FIGS. 2 and 4, an on-off switch 72 and a timer switch 74 are connected in series with the circuit supplying electrical power to the heating element 44. A heat regulator 76, such as a transistor regulator or a simple potentiometer is used to control the temperature of the heating element 44. The switch 72, timer switch 74 and the heating regulator 76 are all attached to the circumferential surface of the housing base 12 adjacent to the power connector 36.

The operation of the rope conditioning apparatus will now be described with reference to FIG. 2. A flexible rope 20, generally made of hemp or manila, is first coiled and then placed on the bottom surface 18 of the housing base 12. The flexible restraining devices 26 are looped over the coiled rope 20 and the snapping devices 30 are then secured to the snap receptacles 28, thereby securing the rope to the housing. In this manner, multiple coiled ropes may be stored within the housing chamber 19. In addition, other ropes may be secured by the flexible restraining devices 56 within the housing cover 14. The housing cover 14 is then rotated about the hinge 16 so that the circumferential edge 62 of the housing cover 14 couples with the circumferential edge 64 of the housing base 12. The power connector 38 is mated to the power receptacle 36, and the power connector 42 is then coupled to a source of 10–15 volts DC voltage although 115 volts AC energy could be utilized with the substitution of an appropriate heating element. The on-off switch 72 is then turned to turned to the on position which activates the heating element 44. The timer switch 74 may be used to automatically limit the duration of the heating cycle. The heating regulator 76 is then adjusted for proper voltage to the heating element 44.

The air contained within the housing is drawn through the multiple perforations 48 to be heated within the shield 46 by the heating element 44. The heated air then expands through the perforations 48 in the shield 46, thereby establishing a small current of heated air throughout housing 10. The temperature of the air within housing 10 during the heating cycle may be reduced by rotating the sliding elements 54 to open the adjustable vents 54 in the top surface 50 of the housing cover 14 or by heat regulator 76. The multiple openings 52 will allow some of the moist air warmed by the heating element 44 to escape without being circulated further through the housing 10. Conversely, the temperature within the housing 10 may be elevated by adjusting heat regulator 76 or by the sliding elements 54, thereby reducing the effective aperture of the vent openings 52. The convection circulation within the housing 10 will evaporate the moisture within the flexible rope 20. The moisture which is contained in the hot air will then be evacuated from the housing through the adjustable vents 52. When the stiffness and moisture content of rope 20 reach the desired level, the power switch may be turned to the off position and the power cord 38 then may be removed. The line conditioning apparatus may also be used as a carrying case for the rope 20. The moisture content of the rope 20 may be stabilized during the transportation process by closing the sliding elements 54 over the vents 52.

A second embodiment of the rope conditioning apparatus is illustrated by FIG. 3. This embodiment is similar to the embodiment as shown in FIG. 2 except that a divider 80 is coupled to a hinge 82 and separates a housing base 86 from a housing cover 83. A heating element 88 for heating a first housing chamber 84 within housing 83 is attached to one side of the disc-shaped divider 80 by the screw-type electrical receptacle 32. A perforated shield which surrounds the heating element 88 is attached to the divider 80 for protecting the rope from contacting the heating element. Multiple vent openings 96 and the adjustable slides 98 rotatably attached adjacent thereto are provided in the housing cover 83. An on-off switch 104, a timer switch 108, and a heat regulator 112 are mounted on the circumferential surface of cover 86 to control the circuitry of heating element 88 through a conductor 99. A single power cord 116 provides power to the apparatus through a power connector 118 located on the circumferential surface of the housing base 86. A second housing chamber 96 is defined by the housing base 86 and the divider 80. Multiple flexible restraining devices 100 are secured to the housings 83 and 86 by fasteners 102. The restraining devices have a snap 90 attached at the distal end thereof for coupling with a second snap element 94.

The second embodiment of the present invention is operated the same as the previously explained first embodiment, except that the second housing cavity 96 may be used to store multiple ropes which have already been conditioned in the first housing cavity 83. In both cases the rope conditioning apparatus 10 should be positioned with multiple vent openings 52 facing upward, and free of any obstructions. The sealed container and the small amount of heat conducted from the first housing cavity 84 through the divider 80 and into the second housing cavity 96 are sufficient to maintain the moisture content of the ropes stored therein.

The rope conditioning apparatus may be constructed of a lightweight metal, such as aluminum, or a heat resistant polymer. The electrical socket should be constructed of an appropriate electrical insulating material and the restraining devices should be manufactured from a heat resistant flexible polymer material.

It will be clear at this point that a rope conditioning apparatus has been provided which overcomes some of the problems of the prior art. However, the invention is not to be construed as limited to the particular embodiments disclosed herein since these are to be regarded as illustrative rather than restrictive.

I claim:

1. An apparatus for conditioning and storing a flexible coiled rope comprising in combination:

a cover having a chamber therein for receiving a coiled rope to be conditioned;

a base having a chamber therein for receiving a coiled rope for storage, said cover being movable attached to said base;

plate means movably attached between said base and said cover for separating said chambers therein;

heating means for heating a coiled rope within said chamber of said cover, said heating plate means being centrally located on said separating means so as to be inside a coil of a rope;

means for protecting said coiled rope from contacting said heating means, said protecting means surrounding said heating means and having a plurality of bores therein for allowing the circulation of air therethrough; and said cover having a plurality of bores therethrough, said bores being adjacent to said heating means for removing a portion of the heat and moisture from said chamber of said cover, whereby the temperature and moisture content of said coiled rope may be conditioned.

2. An apparatus in accordance with claim 1 having means movably attached to said cover adjacent to said plurality of bores therethrough for varying the apertures of said bores, whereby the heat and moisture being removed therethrough may be controlled.

3. An apparatus in accordance with claim 2 wherein said heating means comprises a removable electric light bulb.

4. An apparatus in accordance with claim 3 having circuit means attached to said cover and being operatively connected to said electric light bulb for controlling the heat therefrom, and having a timer attached in said cover and being operatively connected to said electric light bulb for controlling the operating period thereof.

5. An apparatus in accordance with claim 4 in which said heating means has a conductor attached thereto, said conductor being attached to said means movably attached between said base and cover for separating said chambers, said conductor passing into said cover adjacent a hinged connection between said base and cover and being operatively connected to said circuit means and timer whereby said means movably attached between said base and cover having said heating means therein may be moved for entry to said base and cover chambers.

* * * * *